United States Patent [19]

Hein

[11] Patent Number: 4,905,765

[45] Date of Patent: Mar. 6, 1990

[54] SMOKE DETECTOR/REMOTE CONTROLLED SHAPE-MEMORY ALLOY FIRE EXTINGUISHER DISCHARGE APPARATUS

[76] Inventor: George P. Hein, 1900 Parklane, Ellensburg, Wash. 98926

[21] Appl. No.: 234,629

[22] Filed: Aug. 22, 1988

[51] Int. Cl.[4] ..... A62C 37/18; A62C 35/02; A62C 37/06; A62C 37/00

[52] U.S. Cl. ..... 169/61; 169/56; 169/60; 169/26; 169/19

[58] Field of Search ..... 169/DIG. 3, 7, 19, 26, 169/61, 88, 56, 70, 76; 340/328-330

[56] References Cited

U.S. PATENT DOCUMENTS

| | | | |
|---|---|---|---|
| 1,208,863 | 12/1916 | Waldow | 169/19 |
| 3,316,974 | 5/1967 | Cholin | 169/26 |
| 3,768,567 | 10/1973 | Weise | 169/26 |
| 3,917,001 | 11/1975 | Davis et al. | 169/61 |
| 4,027,302 | 5/1977 | Healey et al. | 169/61 |
| 4,596,483 | 6/1986 | Gabriël | 169/40 |
| 4,706,758 | 11/1987 | Johnson | 169/19 |
| 4,753,465 | 6/1988 | Dalby | 292/32 |

FOREIGN PATENT DOCUMENTS

| | | | |
|---|---|---|---|
| 3533268 | 3/1987 | Fed. Rep. of Germany | 169/60 |
| 772557 | 10/1980 | U.S.S.R. | 169/38 |
| 1091934 | 5/1984 | U.S.S.R. | 169/56 |
| 1389786 | 4/1988 | U.S.S.R. | 169/56 |
| 246736 | 2/1926 | United Kingdom | 169/60 |
| 2203646 | 10/1988 | United Kingdom . | |

*Primary Examiner*—Sherman D. Basinger
*Assistant Examiner*—James M. Kannofsky

[57] ABSTRACT

Smoke detector initiated, shape-memory alloy triggered fire extinguisher apparatus creates a reliable, material non-destructive, life sustaining system to suppress or extinguish fires. Low power consumption allows the apparatus to remain latent for long periods of time, be non-destructively tested, and cause fire extinguishers to reliably discharge upon detection of persistent, unsafe smoke conditions. All classes of approved fire extinguishers are controlled. Life forms, sensitive electronic equipment, and other critical mechanisms are protected when liquified gas type fire extinguishers are controlled. The apparatus may be installed in existing unprotected facilities, be installed as primary protection for new facilities, or added as a fast reacting, non-destructive, protection to facilities presently equipped with slower responding sprinkler systems.

5 Claims, 1 Drawing Sheet

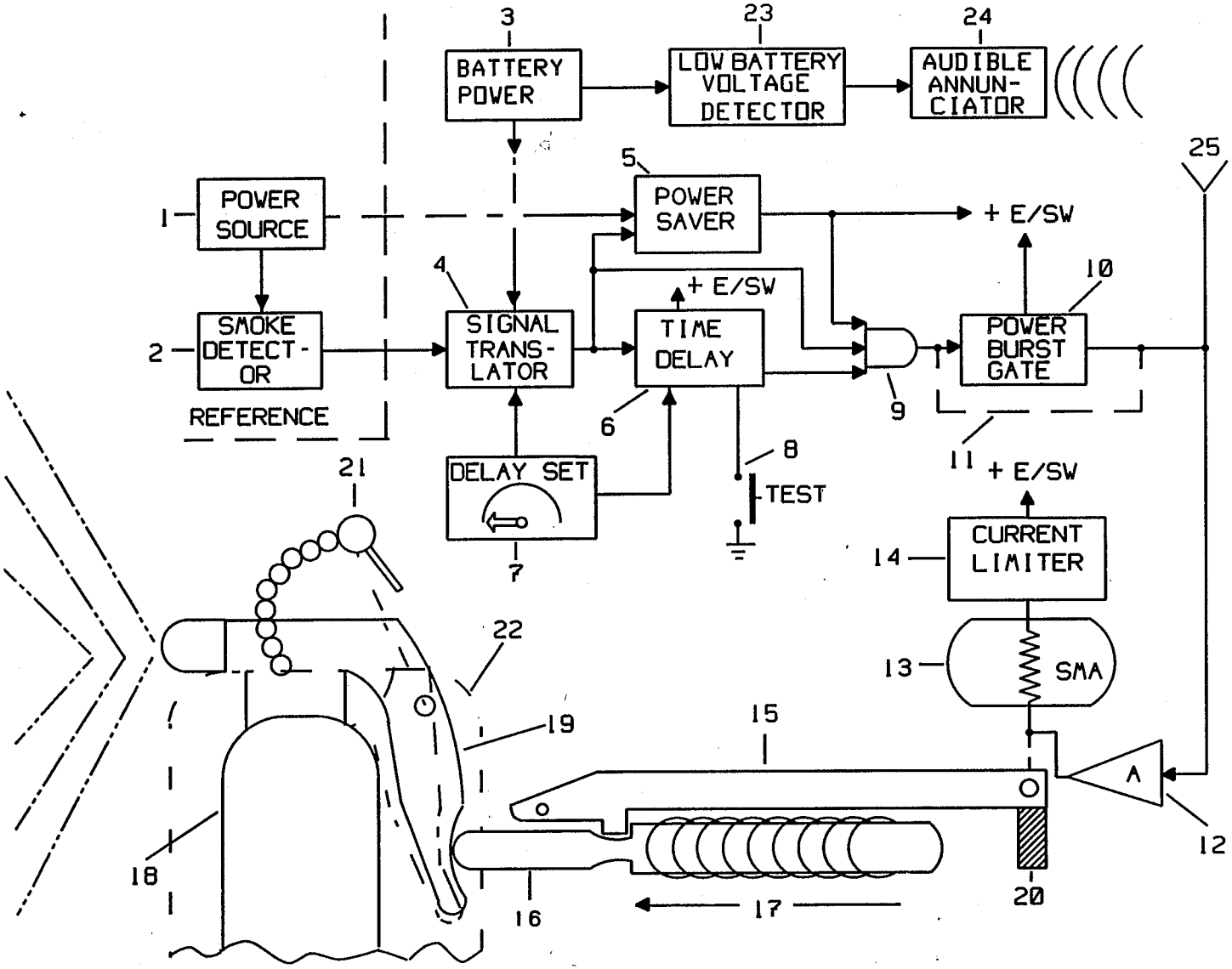
BATTERY POWER
LOW BATTERY VOLTAGE DETECTOR
AUDIBLE ANNUN-CIATOR
POWER SOURCE
SMOKE DETECT-OR
REFERENCE
SIGNAL TRANS-LATOR
POWER SAVER
+ E/SW
TIME DELAY
DELAY SET
TEST
POWER BURST GATE
+ E/SW
CURRENT LIMITER
SMA
A

SMOKE DETECTOR/REMOTE CONTROLLED SHAPE-MEMORY ALLOY FIRE EXTINGUISHER DISCHARGE APPARATUS

REFERENCES

PUBLICATIONS

Disclosure document Number 190721, dated, 9 May 1988 (previous incorrect number, 187165).

Experimenting With Shape-Memory Alloy Wire, Modern Electronics, December 1987, pps 70–75.

SUMMARY OF THE INVENTION

An object of this invention is to provide a low cost, light weight, low power, reliable, non-destructive tested, locally or remotely controlled method of discharging Fire Extinguishers; either by a manual or automatically generated command, or by an alert signal produced by a Smoke Detector.

A further object is that Shape-Memory alloy devices, in whatever physical or electrical configuration, are the mechanical action source to release a major force of great enough magnitude to reliably cause a fire extinguisher or fire extinguishers to discharge. A shape-memory alloy device is an alloy of metals that changes its shape when an electrical current sufficient to heat the apparatus to the threshold point is passed through it. It also changes shape when subjected to excessive ambient heat. After the heat source is removed the shape-memory alloy device returns to its original shape upon coaling.

Another object of said invention is to provide a programmable delay to allow a Smoke Detector to report temporary smoke conditions, but not discharge the Fire Extinguisher. If smokey conditions persist beyond the programmed period of time acceptable for such transitory conditions, the invention causes an electrical current activated shape-memory alloy trigger to release a major force, causing a fire extinguisher or multiple fire extinguishers to discharge.

It is a further object to prevent major fluid damage to equipment, merchandise, hardware, and buildings caused by activation of overhead sprinkler systems. Smoke Detectors controlling strategically placed electrical current activated shape-memory alloy devices which discharge Fire Extinguishers under control of this invention suppress or put out the fire before the sprinkler systems activate.

A most important object is to prevent the loss of life. Smoke Detectors equipped with this invention cause liquified-gas bromochlorodifluoromethane type (or equivalent) Fire Extinguishers, located at strategic sites and in sufficient quantities, to discharge, filling a living space with non-toxic, fire destroying, gas. The gas suppresses or squelches the fire completely, and allows life forms to escape the danger.

Further, another object of this invention is to be capable of operating from, or independent of, normal facility Alternating Current (AC) line voltage; operate from its own internal power source (battery); operate from a controlling Smoke Detector power source; or operate from other reliable power sources, such as Emergency Lighting units.

A prime object of this invention is to remain in a latent state for long periods of time, repeatedly be non-destructively tested, release potential energy Major Force sources, (usually a heavy duty spring), and consume small accounts of electrical power.

Another object is to provide a mechanical, visible "Flag" to indicate when said invention mechanism has been activated.

BACKGROUND OF THE INVENTION

Automatic fire protection to buildings, their contents, and living creatures, has been almost entirely limited to the expensive overhead sprinkler method that is activated by intense heat generated by the fire. These systems are often subject to leakage, and freezing; and failure of the master control, power, and fluid supply. The heavy concentrations of smoke and heat from the fire, prior to sprinkler activation, is of a magnitude to cause severe damage to the building, contents, and death to life forms. Activation of the sprinklers may suppress or extinguish the fire but the structure and its contents are, inevitably, severely damaged, or destroyed by release of the fluid.

An object of this invention is to provide a simple, lightweight, small, low cost, long term reliable, life sustaining, non-destructive tested, low power, independent power source, apparatus to discharge all types of Fire Extinguishers-Class A, B, or C. The purpose is to suppress or extinguish fires upon detection of persistent traces of smoke, rather than waiting for extensive heat build-up, with resultant accumulations of heavy clouds of smoke.

A nominal 10 pound Major Force pressure with a 0.75 inch, minimum release level travel, is required to reliably activate a typical, hand operated, Fire Extinguisher. An arbitrary design criteria is established at 20 pounds Major Force pressure with 1.00 inches of travel. This criteria establishes wide tolerances to accommodate wide manufacturing deviations and shall discharge all Fire Extinguishers. A typical, hand held, Fire Extinguisher is discharge by removal of a Fire Extinguisher from the mounting Holder, removal of the safety pin, and exerting a squeezing pressure on the release lever by hand, in order to discharge a Fire Extinguisher. To retro-fit and use present Fire Extinguishers, this invention provides mounting Holders that requires the safety pin be removed before installation in the Holder, or else the bracket will not accommodate it, and a compressed spring, or other potential energy source, provides the necessary power and the thrust distance to a plunger or retractor, (when released by an electrical current activated shape-memory alloy trigger), to accomplish the discharge of the Fire Extinguisher.

Early experiments indicated that electro-magnetic solenoids lacked the necessary characteristics to reliably perform the operation of discharging Fire Extinguishers, even if mechanical advantage leverage were a part of the mechanism. The electromechanical solenoids are expensive, large, heavy, required too much power, and most of all, lacked sufficient, instantaneous, mechanical pulling power to release a Major Force mechanism to discharge a Fire Extinguisher. Electrical current activated shape-memory alloy trigger devices are the solution to the dilemma. They are cheap, can be manufactured in any configuration deemed desirable, are very small, are lightweight, reuseable thousands of times (for non-destructive testing), withstand great environmental variations, and require very low electrical power to activate.

Obviously, it is not desirable to activate the Fire Extinguishers for transitory, non-dangerous, conditions.

If the electrical current activated shape-memory alloy trigger is Smoke Detector controlled, the Smoke Detector may be temporarily activated by such smoggy conditions as cigarette smoke, cigar smoke, kitchen-stove broiler smoke, and similar situations. These hazy conditions may quickly dissipate. A programmable delay is incorporated to defer the action of discharging the Fire Extinguisher. Only if the smoke condition persists does the electrical current activated shape-memory alloy trigger operate. If the smoggy situation diminishes, within the preset time limit, the trigger does not activate the Fire Extinguisher. Individual electrical current activated shape-memory alloy controlled Fire Extinguishers, (Class A, B, or C) may be strategically located and aimed to protect potentially, volatile, specific spots. The electrical current activated shape-memory alloy trigger devices may be deployed in legions as fire suppression/extinguishers to protect locales from the disastrous consequences of the activation of permanently installed, overhead sprinkler systems. Most importantly, electrical current activated shape-memory alloy triggered Liquified-Gas (such as Bromochlorodifluoromethane) type Fire Extinguishers may be destined to protect life forms and allow them time to escape from dangerous, smoke filled environments, before loss of life occurs, and long before overhead sprinkler systems are activated.

BRIEF DESCRIPTION OF DRAWINGS

1. The FIGURE, Shape-Memory Alloy Fire Extinguisher Discharge Apparatus, (Plunger type Major Force); the drawing illustrates an approved smoke detector supplying an electrical alarm signal and battery voltage, (optional), to the electronic circuits and shape-memory alloy trigger mechanism to release a Major Force discharging a Fire Extinguisher.

EMBODIMENT OF THE INVENTION

Referring to the FIGURE, the operation of this invention is described as follows: Preliminary conditions for this invention to accommodate a typical, unmodified, Original Equipment Manufactured Fire Extinguisher: The safety Lock Pin, 21, is removed from the Fire Extinguisher, 18. The Fire Extinguisher, 18, is then placed in special Fire Extinguisher Holder, 22. Holder, 22, is fabricated for the specific make and model of Fire Extinguisher and will not permit the Fire Extinguisher to be installed unless the Safety Lock Pin, 21, is removed. FIG. 1 illustrates Plunger action of the Major Force, 17, to discharge the Fire Extinguisher. Fire Extinguishers that utilize a retractor lever to discharge the contents requires only that the Major Force retract the Fire Extinguisher discharge retractor lever.

Reference items 1 and 2 are located in an already developed and approved Smoke Detector. Upon detection of smoke, Smoke Detector 1 (Reference), sends an alert output electrical signal to the said invention Signal Translator, 4. Electrical power for this invention is either supplied from the Smoke Detector, 1, (Reference) or smoke detector power source, 2, (reference), or a separate battery, 3, which is an integral part of the invention. The smoke detector power source (battery), 2, may be a source of power for the invention since the invention circuits consume extremely low power. Power is applied to the Signal Translator, 4, only until a valid alert electrical signal is recognized; then power (+E/SW) is applied to all circuits. This feature minimizes current drain on the power source. Signal Translator, 4, ignores the "Low Battery voltage singles," (signals commonly used in many Smoke Detectors). recognizes only valid smoke detected signals, modifies the signal in amplitude and timing characteristics to standardize it for input to the Power Saver circuit, 5; Time Delay circuit, 6, and the AND circuit, 9. Power Saver circuit, 5, applies +E/SW power to all the succeeding stages and activates them. Time Delay, 6, generates a mechanical or electrical time delay, set by an analog or digital technique established by Delay Network, 7. This delay is required to defer operation of the electrical current activated shape-memory alloy trigger in order to compensate for temporary enviromental conditions that might ordinarily set off Smoke Detector, 1. These conditions may quickly dissipate, as they are harmless situations (ie. Kitchen Broiler oven causing temporary hazy conditions). Depending upon the specific application where this invention is employed, the Delay Network, 7, may be adjusted for typical delays of from less than 1 minute to more than 30 minutes; a typical delay is 5 minutes. When Test Switch, 8, is depressed the time delay is shortened to a length of seconds to allow a test smoke generator to activate Smoke Detector, 1, and verify, non-destructively, the operation of this invention. (The Fire Extinguisher, 18, is either disabled or removed from Holder, 22, for test purposes).

If smoke is detected and remains in the vicinity, continuously or intermittently, until the end of the time delay, the environmental circumstances indicate valid smoke detection, and there is a fire threat. At the end of the programmed time period. Time Delay, 6, generates an electrical signal that is ANDed with the Smoke Detector alert (Translated) signal in AND circuit, 9. If smoke is still present after the delay time, the AND, 9, allows a gate signal to pass to the Power Burst Gate, 10, (or bypass the Power Burst Gate by Path 11). Power Burst Gate, 10, is incorporated in this invention when it is desirable to prevent the smoke detector battery, 2, or internal battery, 3, from being drained by continued application of signal to electrical current activated shape-memory alloy Driver, 12. The Power Burst Gate, 10, duration is sufficiently long to insure that electrical current activated shape-memory alloy Device, 13, is fully activated. The time period of the power burst varies, depending upon the characteristics of the specific electrical current activated shape-memory alloy Device, 13, used.

A control signal, derived from manual or other source(s) may be applied at External Source Signal input, 25. This signal causes electrical current activated shape-memory alloy Device, 13, to activate and discharge the Fire Extinguisher, 18.

The current Driver, 12, supplies sufficient drive power to energize electrical current activated shape-memory alloy Device, 13. Current limiter/constant current circuit, 14, limits the current through electrical current activated shape-memory alloy Device, 13, to prevent damage by overheating. This allows the electrical current activated shape-memory alloy Device, 13 to be tested, and repeatedly reused. The electrical current activated shape-memory alloy Device, 13, is physically attached, (as illustrated by the broken line in FIG. 1), to the Mechanical Advantage Lever Trigger assembly, 15. The electrical current activated shape-memory alloy device, 13, when sufficient current is passed through it or extreme heat is applied to it, changes its physical shape, shortens its its length and mechanically withdraws trigger, 15, from the latch notch on Plunger, 16, and allows the Major Force, 17, to cause Fire Extinguisher Discharge Lever, 19, to be physically moved toward the case of the Fire Extinguisher, 18, and to discharge Fire Extinguisher, 18. Activation Flag, 20, is released to visibly indicate that the invention has been activated. The trigger, 15, Major Force, 17, Plunger, 16, and Flag, 20, are manually reset, after activation.

When a separate Battery, 3, is used to power this invention, a Low Battery Voltage Detector circuit, 23, and Audible Annunciator, 24, are incorporated into the invention. When the battery voltage decreases below a predetermined, precautionary, level, the Low Battery Voltage Detector, 23, senses the low voltage condition and causes Audible Annunciator device, 24 to sound alarm noises.

Designed into a new Fire Extinguisher configuration, where this invention is an integral part of the overall unit, the function of the invention is identical to the above description. The Original Equipment Manufacture, is designed so that the Fire Extinguisher, 18, cannot be mounted in Holder, 22, without removing the Safety Lock Pin, 21. In every other respect, the operation of this invention is the same.

When this invention is used to trigger a remotely located Fire Extinguisher, the components of said invention may be located in any convenient location and only the electrical current activated shape-memory alloy Device, 13, Major Force, 17, Plunger, 16, Flag, 20, and Fire Extinguisher, 18, battery, 3, and Holder, 22, are located in the immediate vicinity adjacent to the suspect, volatile, ignition site. The smoke detector and other components may be located where smoke would most quickly accumulate.

Discrete components, integrated circuits, Very Large Scale Integration (VLSI) devices or Microprocessors, or any combination thereof, may be used to perform the required electrical functions.

What's claimed is:

1. A means to discharge at least one fire extinguisher which comprises:

a shape memory alloy means having a certain physical shape;

a battery power source;

an electrical current driver means for forcing a momentary surge of electrical current from said power source through said shape memory alloy means;

a trigger means for discharging said at least one fire extinguisher when said current is forced through said shape memory alloy means;

a smoke detector for supplying electrical alarm signals for activating said electrical current driver means for forcing said momentary surge of electrical current through said shape memory alloy means;

means for decoding said electrical alarm signals to reliably evaluate a persistent smoke threat; and an adjustable timer means for receiving said decoded electrical alarm signals and for preventing immediate discharge of said at least one fire extinguisher by delaying said supply of said electrical alarm signals for activating said electrical current driver means.

2. The discharge means of claim 1 wherein said means for decoding includes a translator means for decoding said electrical alarm signals in voltage level, waveform, and timing characteristics, and for eliminating extraneous information, such as low battery voltage alerts, and thereby reliably initiating said adjustable timer means.

3. The discharge means of claim 1 wherein said adjustable timer means comprises means for inhibiting the discharge of said at least one fire extinguisher for a predetermined period of time if said smoke dissipates before said predetermined period of time has elapsed, and said translator means comprises means for activating the trigger means thereby causing said at least one fire extinguisher to be discharged if said smoke persists beyond said predetermined period of time of said adjustable timer means.

4. The discharge means of claim 1 whereby said timer and said electrical current driver means comprise a means for controlling said momentary surge of electrical current, and said electrical current driver means comprises a means for heating said shape memory alloy means and for changing said physical shape of said shape memory alloy means and thereby releasing said trigger means, and wherein said momentary surge of electrical current is limited in magnitude and duration to prevent destruction of said shape memory alloy and to prevent the complete discharge of said battery power source.

5. The discharge means of claim 1 whereby said shape memory alloy means has a resistance to said electrical current driver means forcing said momentary surge of electrical current through said shape memory alloy means wherein said resistance results in heating said shape memory alloy means and thereby causing said shape memory alloy means to momentarily change its physical shape and thereby release said trigger means and cause said at least one fire extinguisher to discharge.

* * * * *